United States Patent [19]

Fleshman, Jr.

[11] Patent Number: 4,529,120

[45] Date of Patent: Jul. 16, 1985

[54] HEAT GENERATING SYSTEM FOR MULTI-PURPOSE USAGES AND RECOVERY OF PRODUCTS OF COMBUSTION

[76] Inventor: Robert L. Fleshman, Jr., 4325 N. Grand, St. Louis, Mo. 63107

[21] Appl. No.: 547,624

[22] Filed: Nov. 1, 1983

[51] Int. Cl.[3] ..... F23N 1/08

[52] U.S. Cl. ..... 236/20 R; 110/216; 237/8 R; 236/1 G

[58] Field of Search ..... 110/216, 203; 237/56, 237/8 R; 236/1 G, 15 BA, 15 BB, 20 R, 16

[56] References Cited

U.S. PATENT DOCUMENTS

| | | | |
|---|---|---|---|
| 2,243,715 | 5/1941 | Miller | 236/16 |
| 4,242,972 | 1/1981 | Sicard | 110/216 |
| 4,286,528 | 9/1981 | Willard | 110/203 |
| 4,372,487 | 2/1983 | Hollister | 237/56 |

*Primary Examiner*—Henry Bennett

*Attorney, Agent, or Firm*—Gravely, Lieder & Woodruff

[57] ABSTRACT

A heat generating system using solid fuel in a water jacketed combustion chamber for supplying hot water to units for space heaters and hot water storage units, and in which control means is provided for operating the fuel combustion mode to obtain recovery of the products of combustion during low rates of combustion, and to greatly reduce emissions during increased rates of combustion, the control means including thermostatic units having selected points of active and inactive responses.

11 Claims, 5 Drawing Figures

HEAT GENERATING SYSTEM FOR MULTI-PURPOSE USAGES AND RECOVERY OF PRODUCTS OF COMBUSTION

BACKGROUND OF THE INVENTION

1. Field of the Invention

This invention relates to a new, novel and useful heat generating system for multi-purpose usages and for recovery of products of combustion.

2. Description of the Prior Art

It is well known that the burning of fuel, such as coal or wood or combustible substances of solid, liquid or gaseous character produces heat which can be used for many different purposes of commercial, industrial or domestic character. The United States has passed through an era of high cost petroleum base fuels due to the actions of the OPEC cartel boosting prices and thereby forcing a search for substitute fuels. In order to make use of substitute fuels stringent regulations need to be met which in many cases does not result in needed economics. The expense involved in applying approved conventional techniques for heating and cooling purposes has risen to an extent that many would be users cannot afford the benefits which are easily thought of as necessities. In many cases, the excessive cost of the fuel itself is the controlling factor, or the relative scarcity of some fuels that use to be so plentiful can be a controlling factor over costs thereof.

The prior art includes many different forms of apparatus ostensibly well suited for handling the more conventional fuels, such as coal or oil or wood. However, there are problems in applying apparatus for use of these fuels, such as noxious smoke generation, or inefficient use of the known BTU values therein.

BRIEF SUMMARY OF THE INVENTION

The foregoing reference to the prior art is not intended to be exhaustive, but only to furnish a comparison by which to appreciate the valuable characteristics of the present invention.

The objects of the present invention are to create, store, transmit, transfer, convert and distribute heat energy for heating and cooling purposes, using a fuel currently considered to be inferior while being generally in vast supply and thus relatively cheap.

Other objects are to provide apparatus for realizing the most efficient production of the heat values from such inferior fuels, and to arrange the apparatus so in the burning of the fuel relatively little products of combustion are released into the environment so that pollution is not a danger.

The presently known best arrangement for the invention is to incorporate a unique heat producer, using coal or wood as the fuel, as these fuels are generally found in sufficient abundance to be able to put the cost well within the reach of most users, and to adapt the heat producer to make the most efficient use of such fuels.

The present invention embodies a heat generating system suitable for commercial, industrial and domestic apparatus requiring a source of heat in liquid form, such as hot water.

In a preferred embodiment of a heat generating system for multi-purpose usages, a fuel burning boiler constituting the heat generator is provided with an insulated water jacket surrounding the combustion chamber, combustion gas collecting and liquifying means is arranged to return the liquified gas heavy components to the combustion chamber for further burning while releasing the relatively clean vapor residue to the outside, and heated water is distributed into a conduit network which supplies heated water to service devices for clothes washing and drying, for heating a water storage tank, for driving an absorption system for cooling, and for delivering heat to area heating furnaces of the forced air type.

BRIEF DESCRIPTION OF THE DRAWINGS

The present invention is illustrated in its presently preferred form, wherein.

DETAILED DESCRIPTION OF THE EMBODIMENT

Figure 1:
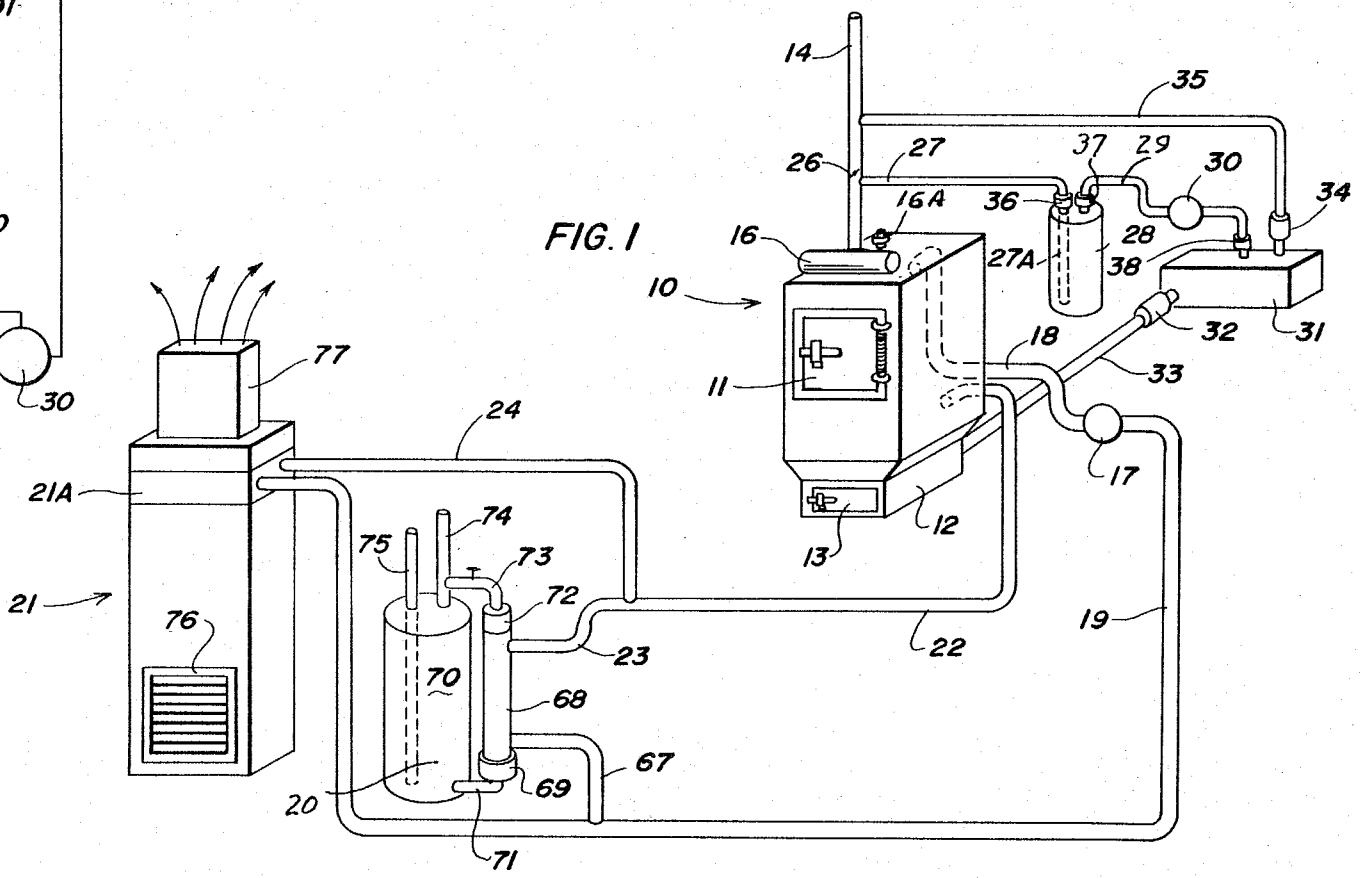
FIG. 1 is a general schematic view, in perspective, of the present heat generating apparatus using a solid fuel, and also a system of accessories associated with the heat generator.

The heat generating system is best seen in the schematic perspective view of the heat generator and heat utilizing equipment connected thereto as in FIG. 1. The heat generator 10, as will be seen in other views is a substantially fully water jacketed boiler which uses solid fuel, such as coal. The generator 10 is provided with a water jacketed feeder door 11 which opens into a fire box forming the combustion chamber. An ash box 12 beneath the combustion chamber is provided with a clean out door 13. The generator 10 is provided with an outlet stack 14 for products of combustion. An expansion tank 16 is positioned on the heat generator 10, and a pressure release safety device 16A is connected to the tank 15 to release pressure should the jacket water heat reach the boiling temperature. The heated water is circulated by a pump 17 which has its inlet in a pipe 18 which reaches into the heat generator at the rear upper zone of the water jacket to be referred to presently. The pump delivery piping 19 is directed in any convenient piping system to accessory equipment, such as an absorption type cooling unit, a water heater and storage assembly 20, and to a forced air heating furnace 21 having a hot water to air heat exchanger section 21A. The water return pipe 22 is connected to the water heater assembly 20 outlet pipe 23 and to the furnace outlet pipe 24. The accessory equipment will be referred to in more detail presently.

COAL TAR AND COAL GAS RECOVERY

As seen in FIG. 1, the boiler stack 14 is provided with a suitable damper valve 26 which acts as an internal cap in the stack 14. The valve 26 is adapted to either close the stack or to open the stack for direct escape of the combustion gases to the exterior. However, when the valve is in the closed position the hot gases are diverted into a by-pass conduit 27 which is connected into a sediment collector tank 28. The conduit 27 extends down close to the bottom of tank 28 as seen at conduit 27A. The sediment or coal tar is collected in the tank 28 and the gaseous portion is moved through the outlet conduit 29 connected to the suction inlet of a pump 30 where this gaseous portion is compressed at the pump back pressure in storage tank 31 which will liquify the gaseous portion. The liquified contents of the tank 31 is conducted through an expansion valve 32 so the liquid is gasified and lead by conduit 33 into the upper zone of the ash box beneath the fire box grate where with the aid of a suitable igniter 59 it is burned so as to recover the BTU values therein without running the chance of having to handle the tar portion of the usual coal gas emission generated most easily during the periods of time when the rate of combustion of the coal in the combustion chamber is slowed or checked to extend the heat producing function of the heat generator 10. There is a certain amount of air in the coal gas which can be released through conduit 35 and back to the stack 14 and to atmosphere without creating a pollution nuisance.

It is an important characteristic of this invention to conveniently service the coal tar and coal gas tanks 28 and 31 respectively by disconnecting the conduit 27 at fitting 36 and conduit 29 at fitting 37. The tank 28 can be removed and replaced with another tank while the collection of coal tar is being extracted. Similarly, the tank 31 can be disconnected at fitting 38, valve 32 and pressure regulator 34 so the liquified coal gas can be used elsewhere when not needed to supply the liquified coal gas as a supplementary fuel in generator 10.

HEAT GENERATOR CONSTRUCTION

Figure 2:
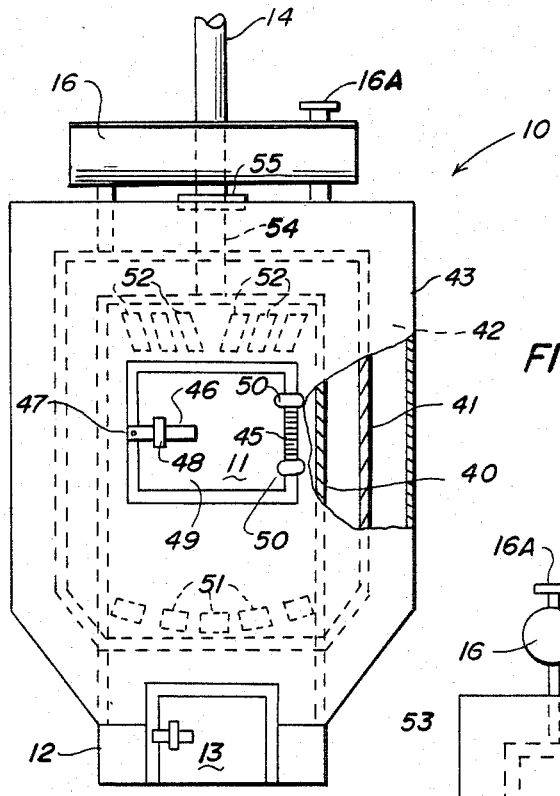
FIG. 2 is a front elevation of the heat generating apparatus.
Figure 3:
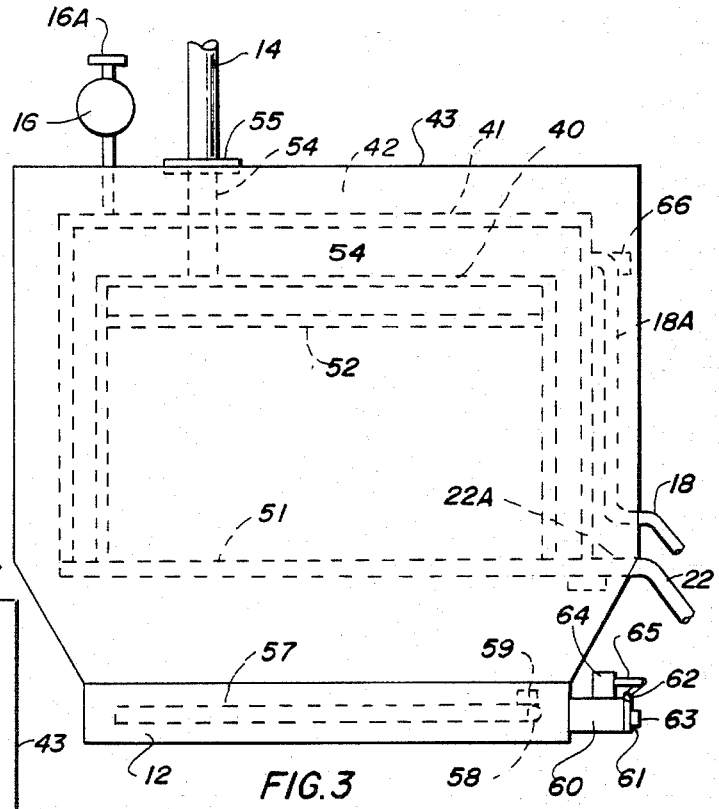
FIG. 3 is a view from the rear of the heat generating apparatus.
Figure 4:
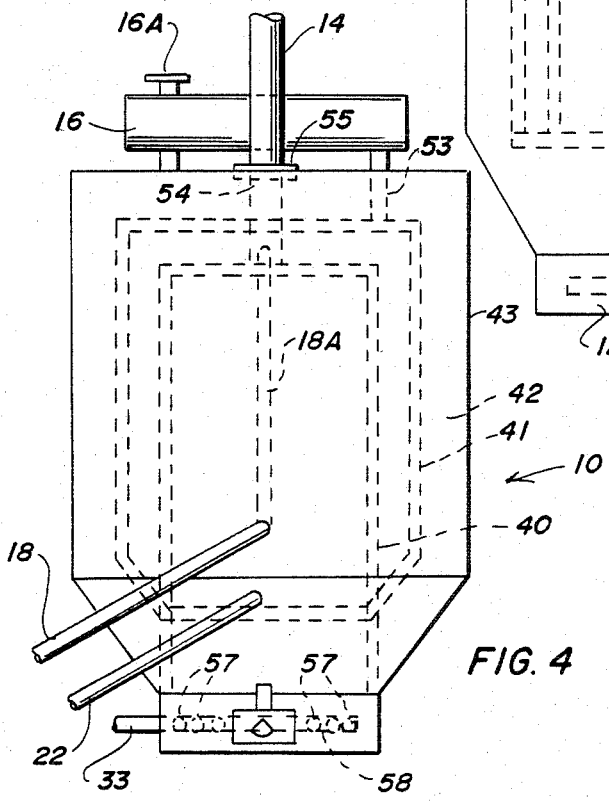
FIG. 4 is a side elevational view of the right side of the heat generator apparatus.

The heat generator 10 is best seen in FIGS. 2, 3 and 4 and reference will be directed to these views. It has been indicated in FIG. 2 that the generator is provided with a shell 40 enclosing a combustion chamber of generally rectangular configuration. The shell 40 forms the inner wall of a water jacket whose outer wall 41 completes the enclosure for the water. The jacket wall 41 is fully encased in a body of insulating material 42, and that body is enclosed by an outer cover 43. Access to the combustion chamber is through the door 11 mounted on hinge 45 and held in closed position by a bar 46 hinged at 47 and adapted to drop into a receiver 48 carried by the door. The door is water jacketed at 49 and the jacket is connected into the jacketed water space by flexible tubes 50.

It is shown in FIGS. 2, 3 and 4 that the combustion chamber shell 40 connects to water conducting grate tubes 51 just above the ash box 12. Additional water conducting tubes 52 are located in the upper space of the fire box which is the normally hottest zone in the heat generator 10. The upper water space in the jacket 41 is provided with a conduit 53 leading out of the cover shell 43 to the expansion tank 16. The fire box shell 40 is provided with a flue pipe 54 which is connected to the stack 14 at the connecting mounting plates 55.

FIGS. 3 and 4 disclose the piping arrangement for leading hot water out of the jacket space and returning it to that space. More specifically in FIG. 4 the hot water outlet conduit 18 is an extension of or is connected to a conduit 18A in the insulation body which is then connected into the top zone of the water jacket. The water return conduit 22 is connected to or is an extension of conduit 22A in the body of insulation near the bottom zone of the water jacket. The water in the heat generator 10 circulates through the grate tubes 51 and up the sides and front of the combustion chamber shell, through the door 11 and the tubes 52 in the top of the combustion chamber shell so that the hottest zone of the water is across the top of the fire box shell 40. Excessive expansion of the water passes up through conduit 53 into the expansion tank 16 where it will cool down and eventually return to the tank. If the pressure in the jacket 40 rises to an excessive value, the safety cap 16A will vent it to the outside.

Furthermore, in FIGS. 3 and 4, there is shown a plurality of burner tubes 57 disposed in the ash box just below the water tubes 51 forming the grate. These tubes 57 are connected to a distributor heater 58 which is, in turn, connected to the gas supply conduit 33 (see FIG. 1). A suitable spark igniter 59 is placed at the header 58 to ignite the gas when it is desired to use the gas contained in the liquifier tank 31.

Figure 5:
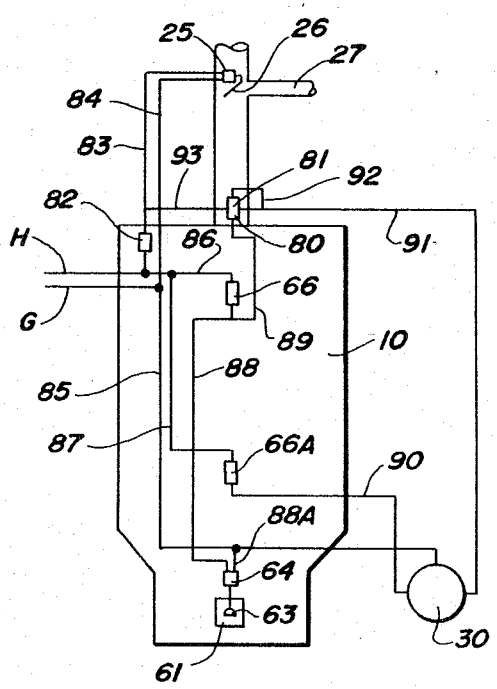
FIG. 5 is a schematically shown control system for operating the present heat generating system.

Referring now to FIG. 5 which is a schematic disclosure of the control components. The silhouette of the back of the heat generator 10 is provided with a manual switch 82 which, as shown, is wired into the solenoid 25 in the stack 14 which operates the damper 26. The base of the stack 14 is provided with a dual thermostat having a low temperature side 80 and a high side 81 (hereinafter 80, 81) which is intended to respond to the temperature of the flue gas moving through the stack 14. The back of the heat generator is provided with a high water temperature thermostat 66 near the upper portion of the water jacket and a low temperature water thermostat 66A placed near the lower portion of the water jacket. As noted in FIG. 4, there is a damper 61 in control of the air inlet 60, and this damper 61 is operated by a solenoid 64.

The power supply is furnished by a hot lead H and a ground lead G so that the manual switch 82 is connected into a circuit from the lead H to a lead 83 connected into the solenoid 25, and a lead 84 from the solenoid 25 is connected back to lead G. There is also a lead 85 from lead G which is connected into the pump motor 30. The lead H is connected into one side of the high water temperature thermostat 66 by lead 86 and a branch lead 87 is connected into one side of the low water temperature thermostat 66A. From the thermostat 66 there is a lead 88 which is connected to the solenoid 64 which operates the damper 61, and the other side of the solenoid 64 is connected by a short lead 88A to the previously noted lead 85. There is a branch lead 89 from lead 88 to the low side of the dual thermostat 80, 81 and there is a lead 90 from the low temperature 66A to the low speed side of the pump motor 30. A lead 91 from the low temperature side of the dual thermostat 80, 81 is connected into the high speed side of the pump motor 30 and it is noted that in this circuit connection with the pump motor 30 it will be able to operate at either 1800 RPM or 3600 RPM. The circuit arrangement of FIG. 6 is completed by a branch lead 92 from lead 91 to the high temperature side of the dual thermostat 80, 81 and the other side of the high temperature side of thermostat 80, 81 is connected by branch lead 93 into lead 83 so as to complete a by-pass circuit to the solenoid 25 at the appropriate time when the manual switch 82 is in open circuit position and the stack temperature is in the appropriate temperature range.

HEAT GENERATOR OPERATION AND CONTROL

During start-up of the heat generator system, a coal fire is ignited in the combustion chamber and combustion air supply is admitted at the air inlet conduit 60

(FIG. 4) which is under the control of a damper 61 arranged so that it will drop to a closed position by gravity. The damper is provided with an adjustable auxiliary air vent 63 to permit a flow of combustion air at low combustion periods of time. In order to obtain air flow through the combustion chamber to support the coal fire, the stack damper valve 26 is opened, and for a short period of time to initiate the combustion of the coal the ash pit door 13 can be left partly open. At other times, as will appear presently, the pump 30 (FIG. 1) is operated to induce a flow of combustion gases out of the stack 14 and into the branch conduit 27 where heavy residue fractions of the combustion, such as coal tar is collected in the tank 28 while the gaseous fractions continue on through conduit 29 to be compressed by the pump 30 and collected in tank 31 in a liquid form. At start-up the water pump 17 is energized to begin water circulation.

Turning now to FIG. 5 it can be appreciated that during the initial start-up of the heat generator 10 it is necessary to operate the manual switch 82 to energize the solenoid 25 for opening the damper valve 26. At this time both sides of the dual thermostat 80, 81 are in normally open contact position, while the high temperature thermostat 66 is in normally closed contact position so as to complete a circuit to the solenoid 64 for holding the damper 61 in open position. During this start-up phase the low temperature thermostat 66A is in normally open position since the temperature of the water returning to the jacket has not been brought up to a temperature range of 90° to 120° F.

As combustion gets going in the heat generator 10 with the damper 61 and valve 26 open, the exhaust gases rise in stack 14 and the water in the water jacket begins to pick up heat. As noted, the water circulating pump 17 is running to keep the jacket water in motion. Manual switch 82 is of course in circuit closed position to hold valve 26 open. During this start-up time, thermostat 66 is in normal circuit closing position because the water in the water jacket has not reached the desired temperature. However, at a given temperature setting which can be anywhere between 160° and 180° F. it will normally break the circuit 88 and 89. Until it does break the circuit 88, damper 61 will remain open and circuit lead 89 will be hot but no response is generated because the low temperature side of the dual thermostat 80, 81 has not reached its temperature range of 110° to 120° F. when it will close. Also during the start-up period the low water temperature thermostat 66A will not close its contact so the circuit 87 and 90 will not be completed and the pump 30 will not be operative.

Now as the exhaust gas in stack 14 gets heated up to the range of temperature of say 120° F., the low side of that thermostat 80, 81 will close, two events occur. These are that the jacket water, being constantly circulated by pump 17, will reach the range of thermostat 66A at 90° to 120° F. to close circuit 87 and 90 to energize the pump 30 to run at about 1800 RPM, and the stack low temperature side of the dual thermostat 80, 81 will reach the temperature range of 120° F. and will close to make the circuit 89 and 91 to switch the pump 30 to its high 3600 RPM speed. All this time the valve 26 will be closed, but as the stack temperature reaches an operating high temperature of 380° to 400° F., signifying a substantially clean burn, the high side of the dual thermostat 80, 81 will close to make a circuit to 93 and 83 so the valve 26 will open. At about this time the water in the water jacket will rise to the preset range as selected at the high temperature thermostat 66 and that thermostat will open and break the circuit 88 to close damper 61, will break circuit 89 and 90 to drop the pump 30 to its range of 1600 RMP by break circuit 92 so the dual thermostat will be fully open and that will allow the valve 26 to close.

Closure of valve 26 in the manner last described will place the heat generator 10 in a state to reducing the fire to a slow rate of combustion where the greatest generation of coal gas and heavy fractions will occur. Now the pump 30 in its low speed range will withdraw the flue gases through branch conduit 27 to yield coal tar fractions and coal gas fractions. This state of semi-animated combustion will continue while the water temperature in the jacket, as sensed by the high temperature thermostat 66, stays at or above the preset range. Combustion will be supported by the opening of the auxiliary vent 63 in the damper 61.

When the jacket water temperature falls below the preset range, as sensed by the thermostat 66 it will again close and reinstate circuits 88 and 89–91 so the damper 61 will open and pump 30 will pick up speed to 3600 RPM to increase the air flow into the combustion chamber by increasing the suction or draw at conduit 27. This sequence of events will again generate combustion gas until the stack temperature rises to the high temperature range to open the valve 26. When the valve 26 opens it signifies a clean burn and reduced coal tar and coal gas production. The restoration of the jacekt water temperature will again cause the thermostat 66 to open, thereby closing damper 61 and slowing the pump 30 as described above.

HOT WATER OPERATED ACCESSORIES

Returning to FIG. 1 the constantly circulated hot water in conduit 19 will bring hot water to a branch tap 67 connected into a heater 68 and from that heater the water will return to conduit 23 tapped into the water return 22 to the heat generator as noted above. The heater 68 comprises an outer jacket, the inner space of which is flooded with hot water that enters at tap 67 and leaves by way of the return 23. The bottom of the heater 68 provides a chamber 69 to receive water from the hot water storage tank 70 at conduit 71. That water after being heated to a range of about 120°–130° F. will rise into header 72 and flow by conduit 73 into the hot water pipe 74 which runs to one or more points in the outlet service system of a building. When no hot water drawn from pipe 74 is called for, the water will merely circulate between the storage tank 70 and the heater 68. A cold water supply pipe 75 is connected into the storage tank in the usual manner.

An important accessory is the furnace 21 which has an internal fan or blower (not necessary to show), which draws air into the inlet 76 and passes it through the exchanger 21A and to discharge plenum 77. The plenum 77 may be the heated air outlet (shown) or it may be connected to an air flow duct work with multiple outlet registers (not shown). The exchanger is connected into the hot water supply conduit 19 and into the return conduit 24. It is to be expected that the fan or blower in the furnace 21 will be responsive to an area thermostatic control which can call for heated air or not as set by the control.

During weather periods when area heating is unwanted, the hot water can be connected into an absorption type refrigeration unit where the heat of the water drives the cooling function. An air circulating system may then move air over the cooler and deliver it to the areas to be cooled. It is believed that absorption refrigeration systems and devices are well known and need not be shown.

It should now be appreciated that the heat generating system for operating a hot water circulating system upon combustion of a solid fuel is able in response to the cooperative action of thermostatic means to maintain a substantially level temperature in the hot water system which is circulated constantly between the water jacket surrounding the combustion chamber in the heat generator and one or more service units such as a hot water storage tank from which hot water may be tapped off in the usual way, or a space heater in which air is passed over a hot water heat exchanger and conducted into duct work leading to area or room outlets, or a hot water exchanger which furnishes the heat to operate an absorption refrigeration unit.

Generally, the heat generating system combines heat generator means for combustion of a solid fuel which is surrounded by a water jacket and is provided with an air inlet to the combustion chamber to support combustion of the fuel and an outlet for the products of combustion. It is a feature of the present invention during certain operating periods of the system to collect the heavy components of combustion such as coal gas and coal tar so as to minimize area pollution, and to do so through a control system which utilizes thermostatic means responsive to low temperature and high temperature water circulation values and to the temperature of the products of combustion which are directed to an outlet stack. The thermostatic means in the control system is utilized to regulate the supply of combustion air and the temperature of the products of combustion in the outlet stack so as to maintain a substantially level temperature value of the water in the circulating system, and concurrently to remove products of combustion to collection tanks where the coal tar fractions are separated out from coal gas fractions and the coal gas fractions are compressed to a liquid state for subsequent use. In one arrangement of control means there is a damper valve in the outlet stack from the combustion chamber to determine when there is a substantially clean burn of the fuel which can be released to the outside and when the products of combustion are to be removed from the stack and collected so as to avoid area pollution, all of which is responsive to the thermostatic control operating partly on the desired temperature of the water in the water jacket and partly in response to the temperature of the products of combustion in the outlet stack.

It is to be understood that the foregoing disclosure is not to be unnecessarily limited as variations may come to mind as the principals of the invention are more fully understood.

What is claimed is:

1. In a heat generating system employing a solid fuel for driving hot water activated accessories and for recovery of products of combustion, the system comprising:

(a) heat generating means having a fuel combustion chamber enclosed in a water jacket and an outlet for the products of combustion;

(b) burner means disposed in said heat generator means for heating the water in said water jacket;

(c) a combustion ash residue collecting box in communication with the combustion chamber;

(d) means communicating with said ash residue collecting box for admitting combustion supporting air, said air admitting means having a damper control;

(e) a stack connected to said combustion chamber outlet for the products of combustion; and (f) products of combustion recovery means operatively connected into said stack and including (1) a first collector for heavy residue fractions of combustion and gaseous fractions of combustion, (2) compression means for extracting the gaseous fractions from said first collector and for drawing the products of combustion out of said stack, (3) a second collector connected to said compression means for storing the gaseous fraction at a pressure sufficient to liquify the same; and (4) a connection between said burner means and said second collector for liquified gaseous fractions, said connection having an expansion valve means operative to convert the liquified gaseous fractions back to a gaseous fraction suitable for burning by said burner means to recover the heat values thereof.

2. The heat generating system set forth in claim 1 wherein the solid fuel is coal, said collector for heavy residue fractions retains coal tar and said compression means liquifies the gaseous fractions for storage in said second collector.

3. The heat generating system set forth in claim 1 wherein said first collector is selectively detachable from said products of combustion recovery means for recovery of the coal tar collected therein.

4. The heat generating system set forth in claim 1 wherein said second collector is selectively detachable from said products of combustion recovery means for recovery of the liquified fraction therein.

5. The heat generating system set forth in claim 1 wherein a hot water circulating system is connected into said water jacket, and includes means for maintaining circulation of the hot water.

6. The heat generating system set forth in claim 6 wherein hot water utilizing means is connected into said hot water circulating system, said utilizing means being operative for extracting the heat content from said circulating system and returning cooled down water thereto.

7. The heat generating system set forth in claim 7 wherein said hot water utilizing means is a hot water storage means having a heat exchanger in water circulating flow therewith, and said heat exchanger is connected into heat exchange transfer from said hot water circulating system.

8. The heat generating system set forth in claim 7 wherein said hot water utilizing means is a housing for the directing of air movement between an inlet and an outlet in spaced relation, and a heat exchanger connected into said water circulating system is mounted in the path of air movement in said housing to impart heat to the moving air.

9. In a heat generating system employing solid fuel for driving a water heating generator and for recovery of products of combustion, the system comprising:

(a) heat generating means having a fuel combustion chamber with an air inlet and a products of combustion outlet stack;

(b) jacket means substantially surrounding said combustion chamber for containing a body of water to be heated, said jacket means having a water outlet and inlet;

(c) a water circulating system having a hot water receiving connection with said jacket means and a heat spent water return connection with said jacket means;

(d) products of combustion recovery means including a conduit connected into said outlet stack, container means connected to said conduit and pump means connected to said container means for moving the products of combustion recovered from said outlet stack through said conduit into said container means; and (e) control means operably connected into said heat generating means adjacent said air inlet, said outlet stack, said hot water receiving connection, said heat spent water return connection, and said pump means, said control means monitoring the combustion of fuel in response to the temperature of the jacket water and the temperature of the products of combustion at said outlet stack, whereby the solid fuel combustion is maintained at a rate of consumption to hold the jacket water temperature at said water circulating system receiving connection in a preselected range of temperature of from about 160° to about 180° F., and to recover a substantial portion of the products of combustion from said outlet stack prior to release to the ambient atmosphere.

10. The system set forth in claim 9 wherein said control means comprises an air inlet control damper associated with said combustion chamber, a products of combustion control valve in said outlet stack, and thermostatic means in an electrical circuit system for controlling the opening and closing of said damper and valve in reaction to the response of said thermostatic means to the temperature of the hot water adjacent said water outlet, the temperature of the heat spent water adjacent said jacket inlet and the tmeperature of the products of combustion in said outlet stack.

11. The system set forth in claim 10 wherein said thermostatic means automatically controls said damper and valve for maintaining the solid fuel combustion in a state of providing heat of the water in said jacket means at a temperature preselected within the range of 160° to 180° F.

* * * * *

UNITED STATES PATENT AND TRADEMARK OFFICE

CERTIFICATE OF CORRECTION

PATENT NO. : 4,529,120

DATED : July 16, 1985

INVENTOR(S) : Robert L. Fleshman, Jr.

It is certified that error appears in the above-identified patent and that said Letters Patent are hereby corrected as shown below:

Column 8, line 42, after "in" delete "claim 6" and insert ---claim 5---.

Column 8, line 48, after "in" delete "claim 7" and insert ---claim 6---.

Signed and Sealed this

*First* Day of *October 1985*

[SEAL]

*Attest:*

DONALD J. QUIGG

*Attesting Officer*

*Commissioner of Patents and Trademarks—Designate*